US008517553B2

(12) United States Patent
Lan et al.

(10) Patent No.: US 8,517,553 B2
(45) Date of Patent: Aug. 27, 2013

(54) FAN LIGHT APPARATUS

(75) Inventors: Charles Lan, Dongguan (CN); Guo-You Liu, Dongguan (CN)

(73) Assignee: Superiorlite Corporation Limited, Dongguan (CN)

( * ) Notice: Subject to any disclaimer, the term of this patent is extended or adjusted under 35 U.S.C. 154(b) by 343 days.

(21) Appl. No.: 13/106,243

(22) Filed: May 12, 2011

(65) Prior Publication Data

US 2012/0287604 A1 Nov. 15, 2012

(51) Int. Cl.
*F21S 8/04* (2006.01)

(52) U.S. Cl.
USPC ..... 362/96; 362/147; 362/404; 362/405; 362/406

(58) Field of Classification Search
USPC ..... 417/423.15; 416/246, 5, 8, 24, 59, 416/142, 143; 454/269, 329, 9, 15, 18, 21, 454/30
See application file for complete search history.

(56) References Cited

U.S. PATENT DOCUMENTS 4,199,803 A * 4/1980 Hunt, III ..... 362/263
6,322,232 B1 * 11/2001 Oliver ..... 362/147
2007/0247854 A1 * 10/2007 Lin ..... 362/294

* cited by examiner

*Primary Examiner* — Sharon Payne
(74) *Attorney, Agent, or Firm* — Bacon & Thomas, PLLC

(57) ABSTRACT

A fan light apparatus comprises: a ceiling mount disk; a light frame, coupled to the ceiling mount disk; a lamp, fixed onto the light frame; a fan installing case, installed to the bottom of the light frame; a fan motor, installed in the fan installing case; a vane, pivotally coupled to the fan motor spindle; a support, movably coupled to an internal side of the bottom of the fan installing case; a wind-guide fan motor, fixed to the center of the support; a wind-guide vane, sheathed on a spindle of the wind-guide fan motor; a latch, pivotally coupled to the spindle of the wind-guide fan motor for supporting the wind-guide vane; and an anion generator, installed in a space between the vane and the wind-guide vane.

9 Claims, 8 Drawing Sheets

FAN LIGHT APPARATUS

BACKGROUND OF THE INVENTION

1. Field of the Invention

The present invention relates to a fan light apparatus, in particular to a fan light apparatus that combines a suspended illumination lamp and a circulating fan.

2. Description of the Related Art

Suspended illumination lamp and suspended hanging fan are conventional electric appliances, and at an early stage, the suspended illumination lamp and the suspended hanging fan were generally two separate products which are installed and used separately. Later, there was a product that combined the suspended illumination lamp with the suspended hanging fan introduced to the market, but such product primarily based on the suspended hanging fan to combine the illumination lamp to the bottom of the hanging fan, such that a long vane of the hanging fan can rotate above the lit illumination lamp. When viewed, we can obviously see that the hanging fan is the main decorative body of a building, and the illumination lamp is just an accessory. Such product also has the following drawbacks:

1. In the conventional suspended hanging fan product with the attached illumination lamp, after the installation, the vane occupies most of the visual space of the ceiling and holds most of the visual perception of the viewers, such that the attached illumination lamp looks relatively small and less significant. As to buildings desiring to have the illumination lamp as the main decorative body, it is inappropriate to install such suspended hanging fan with the attached illumination lamp.

2. In the conventional suspended hanging fan or the suspended hanging fan with the attached illumination lamp, the vane is rotated in a single direction, such that wind is always blown in the same direction to a position, and random changes or switches to a different direction are not allowed. Obviously, the wind so blown is not natural.

3. In the conventional suspended hanging fan or the suspended hanging fan with the attached illumination lamp, dusts may be accumulated on the long vane after a long time of use. Due to the long length of the vane and the installation of the fan at a high position, it is very inconvenient to clean the fan.

SUMMARY OF THE INVENTION

In view of the aforementioned drawbacks of the prior art, the inventor of the present invention based on years of experience in the related industry to conduct extensive researches and experiments, and finally developed a fan light apparatus of the present invention that uses the illumination lamp as the main decorative body to overcome the shortcomings of the prior art.

Therefore, it is a primary objective of the present invention to provide a fan light apparatus that uses the illumination lamp as the main decorative body.

Another objective of the present invention is to provide a fan light apparatus capable of switching different wind blowing directions and blowing wind more naturally.

Another objective of the present invention is to provide a fan light apparatus that can be cleans easily.

Another objective of the present invention is to provide a fan light apparatus capable of generating anions as the wind is produced by the vane, so as to achieving the effects of purifying the air, maintaining a clean and hygienic environment, and providing a comfortable using environment To achieve the foregoing objectives, the present invention provides a fan light apparatus, comprising a ceiling mount disk, a light frame, a lamp, a fan installing case, a fan motor, a vane, a support, a wind-guide fan motor, a wind-guide vane and a latch, wherein the ceiling mount disk is installed and mounted to an installing position; the light frame is coupled to the ceiling mount disk; the lamp comprises a lamp holder and a light bulb, and the lamp holder is fixed onto the light frame, and then the light bulb is coupled to the lamp holder; the fan installing case is installed at the bottom of the light frame and surrounded by the lamp, and the bottom of the fan installing case is substantially in form of an opening, and a plurality of air holes are formed at peripheries of the top wall and the sidewall of the fan installing case, and an installing space is formed therein; the fan motor is installed to an internal side of the top wall of the fan installing case; the vane is pivotally coupled to the fan motor spindle and driven by the spindle of the fan motor spindle to rotate; the support is a rod-shaped object, with at least two ends abutted against the internal edges of the bottom of the fan installing case and at least one end movably coupled to the internal edge of the bottom of the fan installing case; the wind-guide fan motor is a power device installed at the center of the support for performing clockwise and counterclockwise rotations alternately, and the spindle of the wind-guide fan motor is extended downward; the wind-guide vane is sheathed on the spindle of the wind-guide fan motor; and the latch is pivotally coupled to the wind-guide fan motor spindle for supporting the wind-guide vane; such that cool wind blown from the vane is provided for blowing in different directions alternately and facilitating a cleaning job.

In the present invention, the light frame is a frame having a plurality of support arms in a decorative bent shape, whose center of the top side is coupled to the ceiling mount disk, and the bottom of the external periphery of each support arm is provided for coupling the lamp.

In the present invention, the lamp comprises a lamp cup, a lampshade, a lamp holder, a combining part and a light bulb, and the lamp cup and the lamp holder are fixed to the light frame, and the lampshade is coupled to the lamp cup by screwing and securing the combining part with the lamp holder, and then the light bulb is coupled to the lamp holder.

In the present invention, the lamp comprises a lamp arm, a lampshade, a lamp holder and a light bulb, and the lamp arm is disposed around the external periphery of the fan installing case, and the lamp holder is coupled to the lamp arm, and the light bulb is coupled to the lamp holder, and the lampshade is sheathed to the lamp holder for surrounding and covering the light bulb.

In the present invention, the fan installing case is comprised of an upper cover, a middle ring and a lower ring.

In the present invention, the upper cover, the middle ring and the lower ring of the fan installing case are manufactured into a one-piece structure directly.

In the present invention, the upper cover and the middle ring of the fan installing case are manufactured into a one-piece structure the fan installing case, and then the lower ring is coupled to the middle ring from the bottom.

In the present invention, the fan installing case is formed by assembling an upper cover, a middle ring and a lower ring sequentially.

In the present invention, an anion generator is further installed in a space between the vane and the wind-guide vane for generating anions, and the vane drives and blows the anions by wind.

DETAILED DESCRIPTION OF THE PREFERRED EMBODIMENTS

Figure 1:
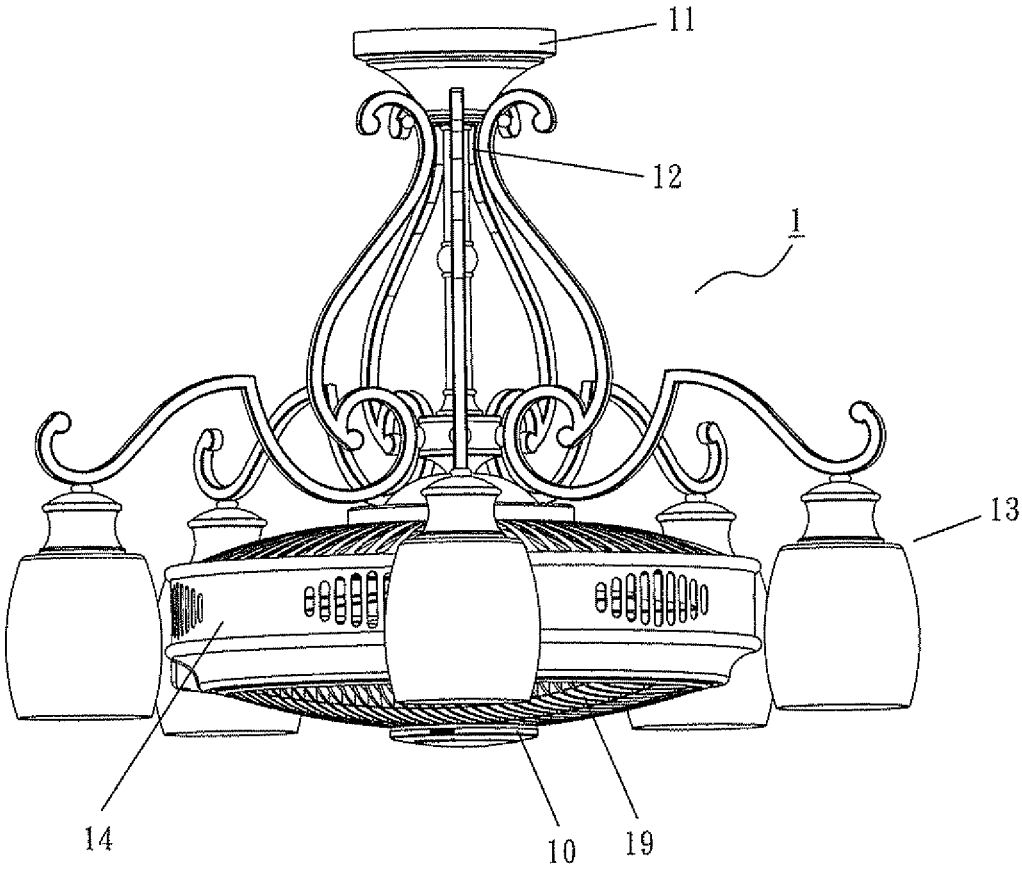
FIG. 1 is a perspective view of a first preferred embodiment of the present invention.

To make it easier for our examiner to understand the technical characteristics and measures of the present invention to achieve the aforementioned objects and effects, we use preferred embodiments with related drawings for the detailed description of the present invention as follows.

With reference to FIGS. 1 to 5 for a fan light apparatus in accordance with a first preferred embodiment of the present invention, the fan light apparatus 1 comprises a ceiling mount disk 11, a light frame 12, a lamp 13, a fan installing case 14, a fan motor 15, a vane 16, a support 17, a wind-guide fan motor 18, a wind-guide vane 19 and a latch 10. the ceiling mount disk 11 is mounted to an installing position (such as the ceiling), for covering a power cable and a protruding hole of the power cable; the light frame 12 is a frame having a plurality of support arms in a decorative bent shape, but the invention is not limited to this shape only; and the top end at the center of the light frame 12 is coupled to the ceiling mount disk 11, and the bottom of the external periphery of each support arm is provided for coupling each lamp 13.

Each lamp 13 comprises a lamp cup 131, a lampshade 132, a lamp holder 133, a combining part 134 and a light bulb 135, wherein the lamp cup 131 and lamp holder 133 are fixed to the light frame 12, and the lampshade 132 is screwed tightly with the lamp holder 133 by the combining part 134 and coupled to the lamp cup 131, and then the light bulb 135 is coupled to the lamp holder 133, and each lamp holder 133 is coupled to an electric wire which is passed through the light frame 12 and the ceiling mount disk 11 and then electrically coupled to the power cable, such that each lamp holder 133 is electrically conducted for driving the light bulb 135 to be lit. The lampshade 132 can have different shapes, and the light bulb 135 is actually a light emitting component driven electrically and can be a traditional light bulb (or lamp tube), a power-saving light bulb (lamp tube), an LED light bulb (lamp tube) or any electric light emitting component.

Figure 2:
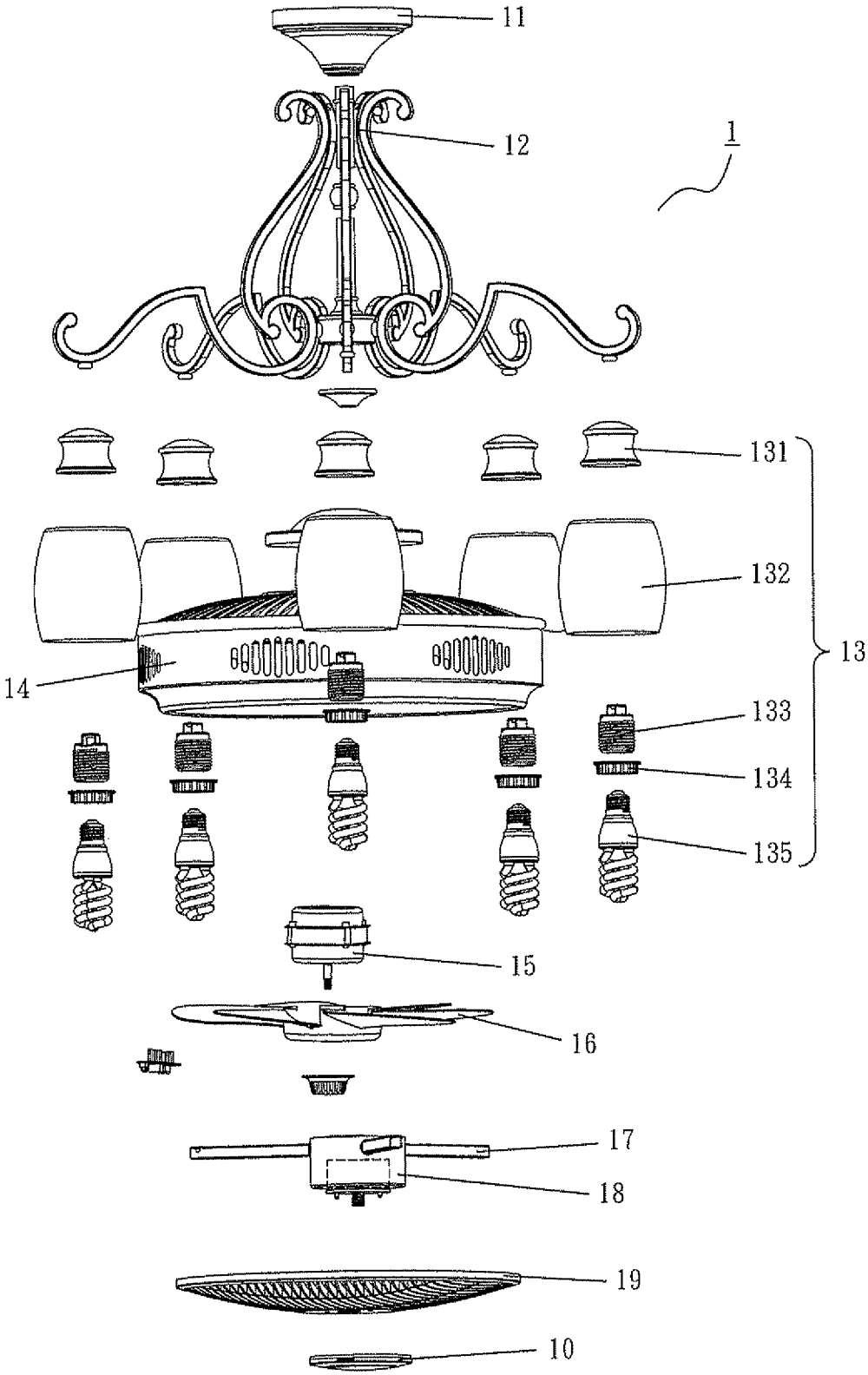
FIG. 2 is an exploded view of a first preferred embodiment of the present invention.
Figure 3:
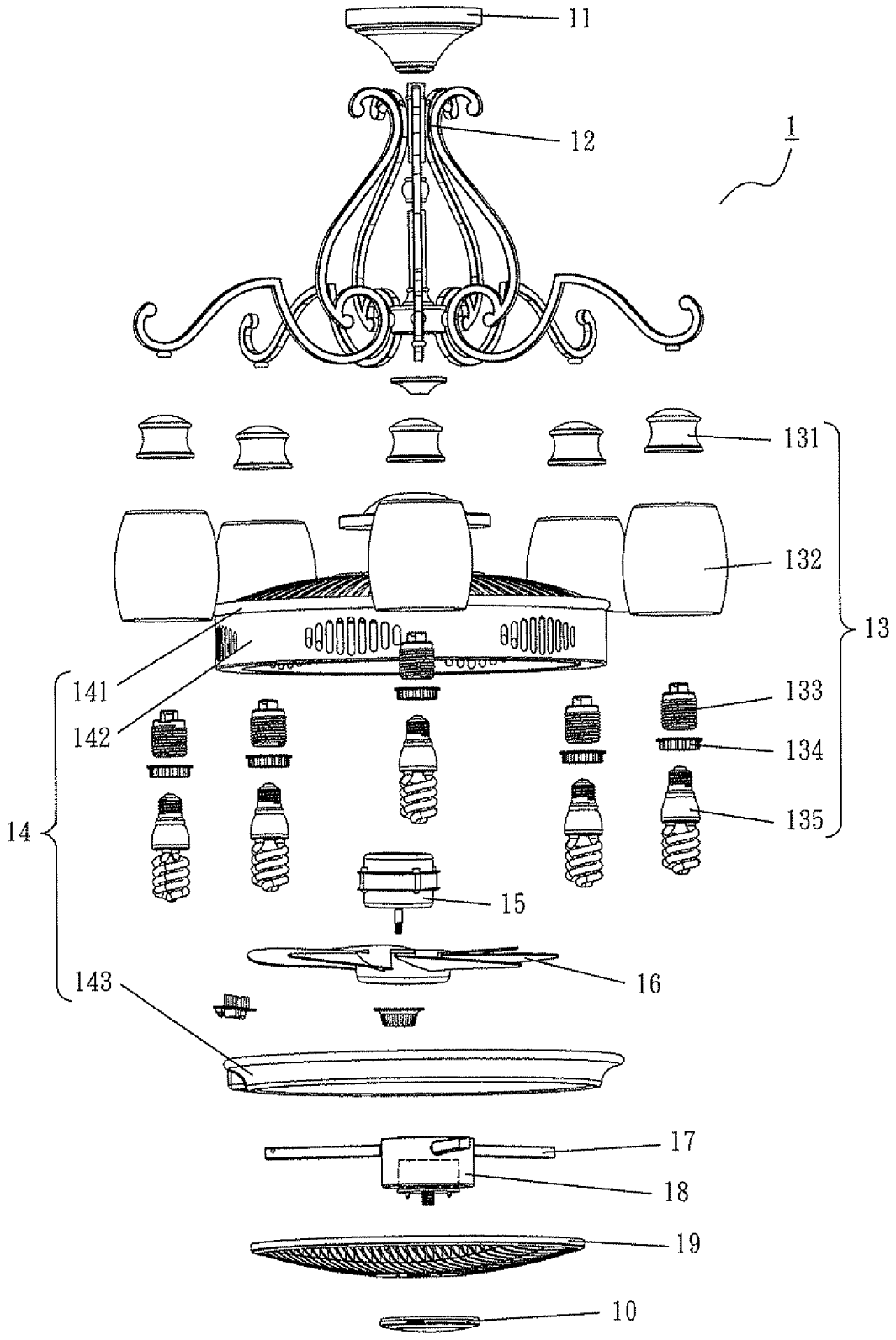
FIG. 3 is a schematic view of a structural variation of a first preferred embodiment of the present invention.
Figure 4:
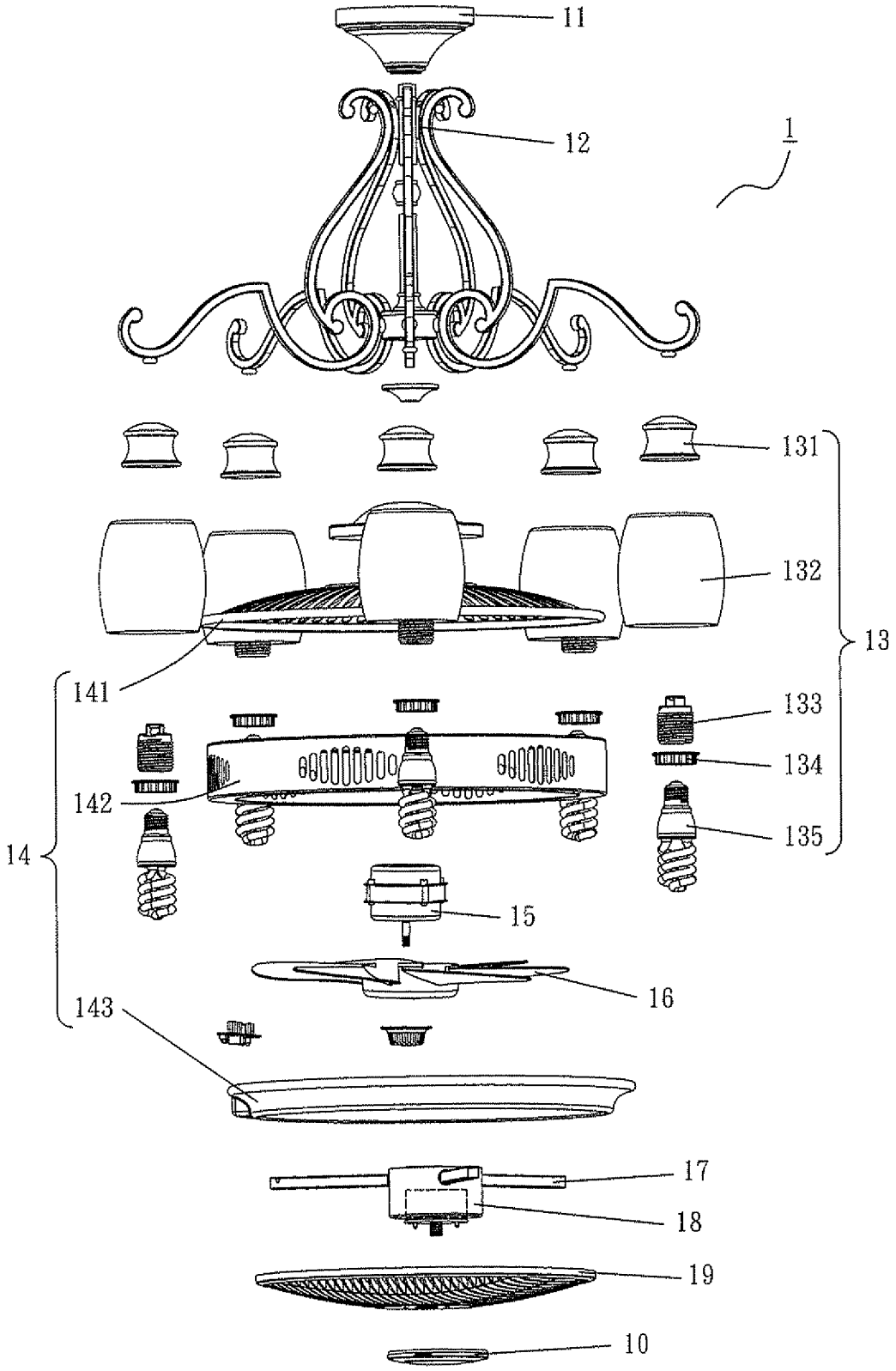
FIG. 4 is a schematic view of a structural variation of a first preferred embodiment of the present invention.

The fan installing case 14 is installed at the bottom of the light frame 12 and surrounded by each lamp 13, such that each lamp 13 shows the maximum visual body in the space. The bottom of the fan installing case 14 is substantially in the shape of an opening, and a plurality of air holes are formed on peripheries of the top wall and the sidewalls, and an installing space is formed therein; the fan installing case 14 is comprised of an upper cover 141, a middle ring 142 and a lower ring 143, and can be manufactured into various different forms such as the form as shown in FIG. 2, wherein the upper cover 141, the middle ring 142 and the lower ring 143 are manufactured into a one-piece structure directly, such that the fan installing case 14 is a one-piece box with an open bottom; or the form as shown in FIG. 3, wherein the upper cover 141 and the middle ring 142 are manufactured as a one-piece structure, and then the lower ring 143 is coupled to the middle ring 142 from the bottom; or the form as shown in FIG. 4, wherein the fan installing case 14 is formed by assembling the upper cover 141, the middle ring 142 and the lower ring 143 sequentially.

Figure 5:
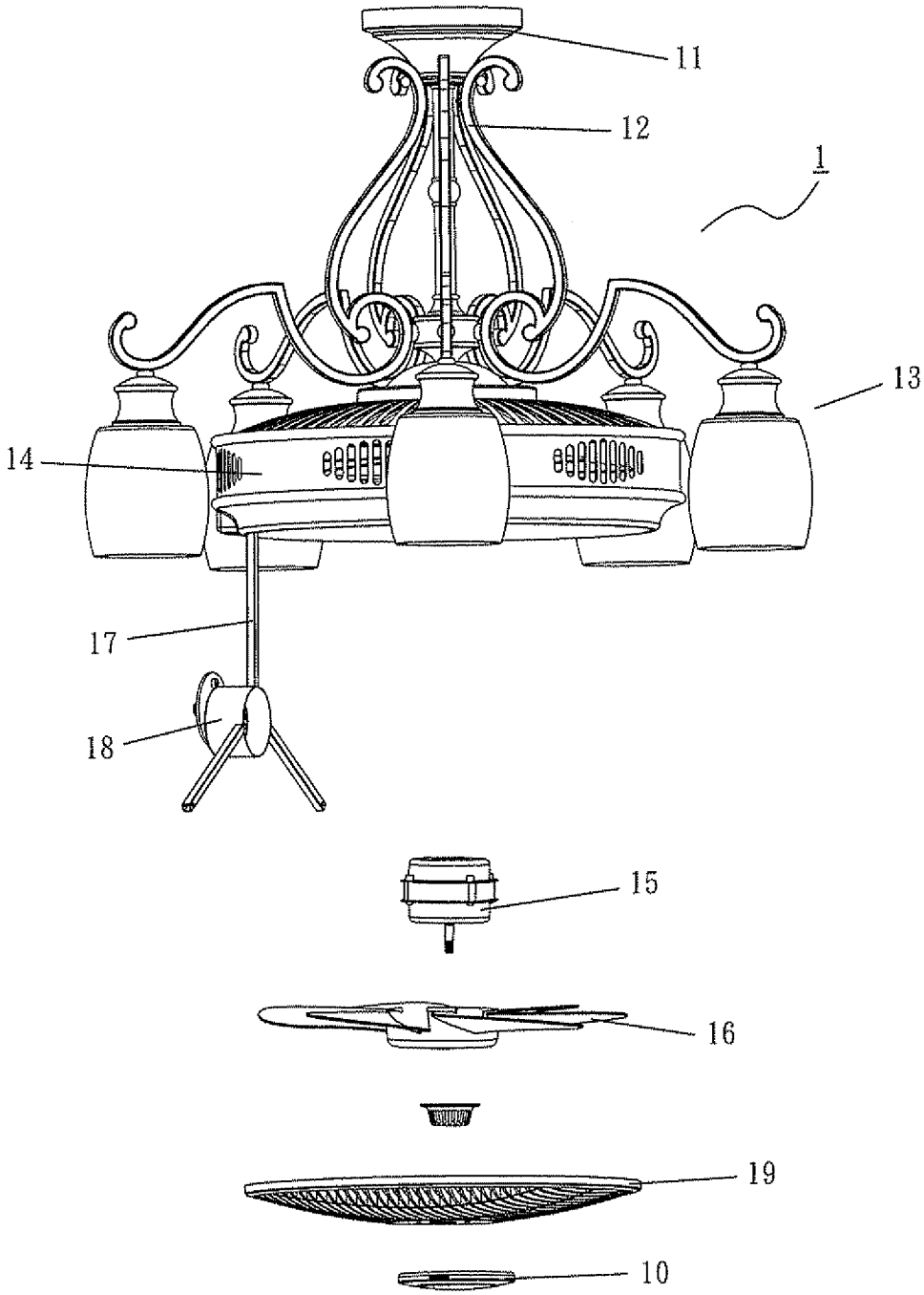
FIG. 5 is a schematic view of an operation of a first preferred embodiment of the present invention.

The fan motor 15 is installed at the internal side of the top wall of the fan installing case 14, and the fan motor 15 is coupled to an electric wire which is passed through the light frame 12 and the ceiling mount disk 11 and then electrically coupled to the power cable, such that the fan motor 15 can be electrically conducted. The vane 16 is pivotally coupled to a spindle of the fan motor 15 and driven and rotated by the spindle of the fan motor 15 to blow wind downward. Of course, the wind can be blown selectively in an upward direction. The support 17 is a rod-shaped object with at least two ends abutted against the lower ring 143, and at least one end movably coupled to the lower ring 143, so that the support 17 can serve as a movably coupled end or an end for detaching the lower ring 143 as needed, so that the movably coupled end can be provided as a fulcrum and substantially in a drooping form (as shown in FIG. 5). Of course, the support 17 can be reinstalled anytime, such that the support 17 can be provided for installing inside the lower ring 143.

The wind-guide fan motor 18 is installed at the center of the support 17, such that the spindle is extended downward, and the wind-guide vane 19 is sheathed on a spindle of the wind-guide fan motor 18, and the latch 10 is provided for pivotally coupling the spindle of the wind-guide fan motor 18 and supporting the wind-guide vane 19. The wind-guide fan motor 18 is connected with the fan motor 15 in series for receiving electric power jointly, and the wind-guide fan motor 18 is a power device provided for performing clockwise and counterclockwise rotations alternately, so that when the wind-guide vane 19 is driven and rotated, the wind-guide vane 19 can perform clockwise and counterclockwise rotations alternately. In other words, users can selectively control the wind-guide vane 19 to rotate in the same direction, or change the control to rotate the wind-guide vane 19 in another direction; or selectively control the wind-guide vane 19 to change the rotating direction at a set time directly, sot that the wind-guide vane 19 will rotate in a clockwise direction for a period of time, and then change its rotation in a reverse direction automatically, and then changes back to the clockwise rotation again after a period of time, so on and so forth to achieve the effect of switching the rotating direction alternately and automatically.

In the fan light apparatus 1, the overall appearance looks like a suspended illumination lamp, which is expressed by the lamps 13, and the illumination lamp is the main decorative body provided for improve the aesthetic look of a building. In the condition of using the illumination lamps as the main decorative body, the fan installing case 14, the fan motor 15 and the vane 16 are installed in the space surrounding the lamps 13, so that cool wind can be blown downward, which is the main difference from the conventional suspended hanging fan attached with an illumination lamp. In addition, the support 17, the wind-guide fan motor 18, the wind-guide vane 19 and the latch 10 are installed under the vane 16, so that cool wind blown from the vane 16 can be guided in a clockwise direction or a counterclockwise direction, or in an automatic switching of clockwise and counterclockwise rotations, so as to achieve the effect of blowing wind naturally. In addition, the latch 10 and the wind-guide vane 19 can be removed, such that the movably coupled end can be used as a fulcrum for detaching the support 17 from the lower ring 143 and drooped as shown in FIG. 5, and the vane 16 can be exposed to facilitate detaching the vane 16 for cleaning, or cleaning the vane 16 directly without detaching the vane 16, so as to achieve an easy cleaning the effect.

Figure 6:
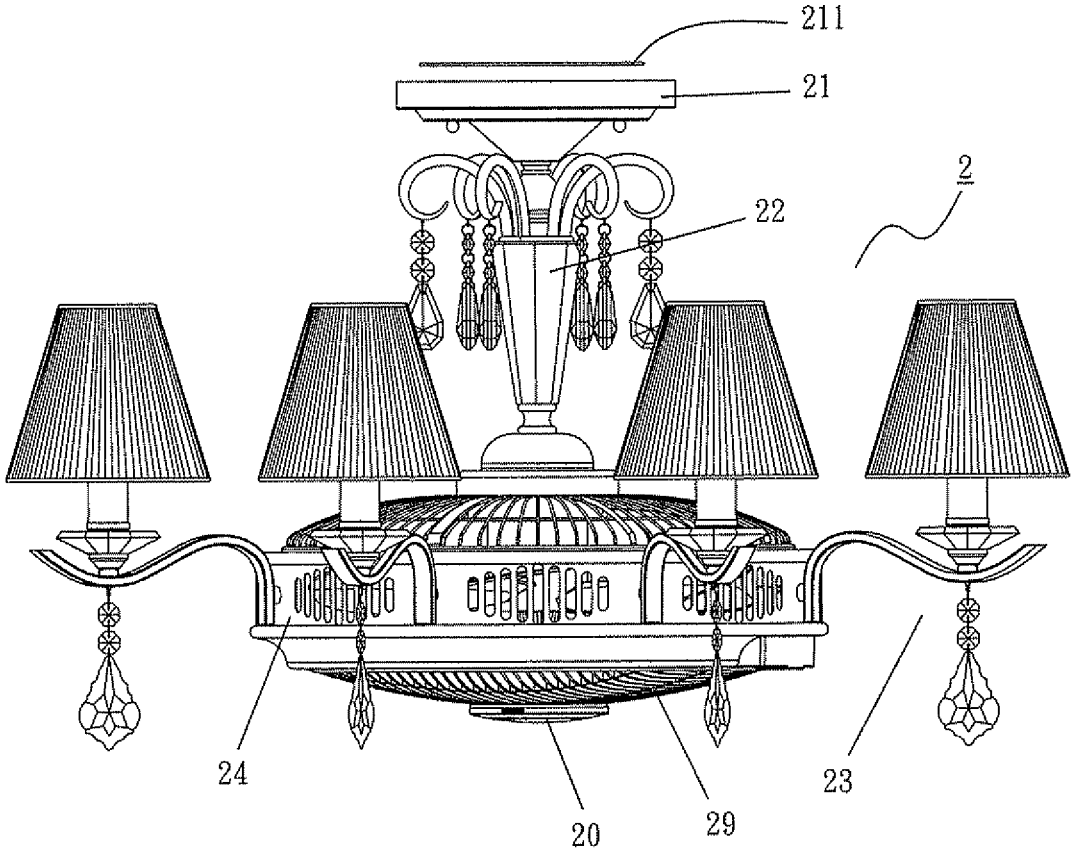
FIG. 6 is a perspective view of a second preferred embodiment of the present invention.
Figure 7:
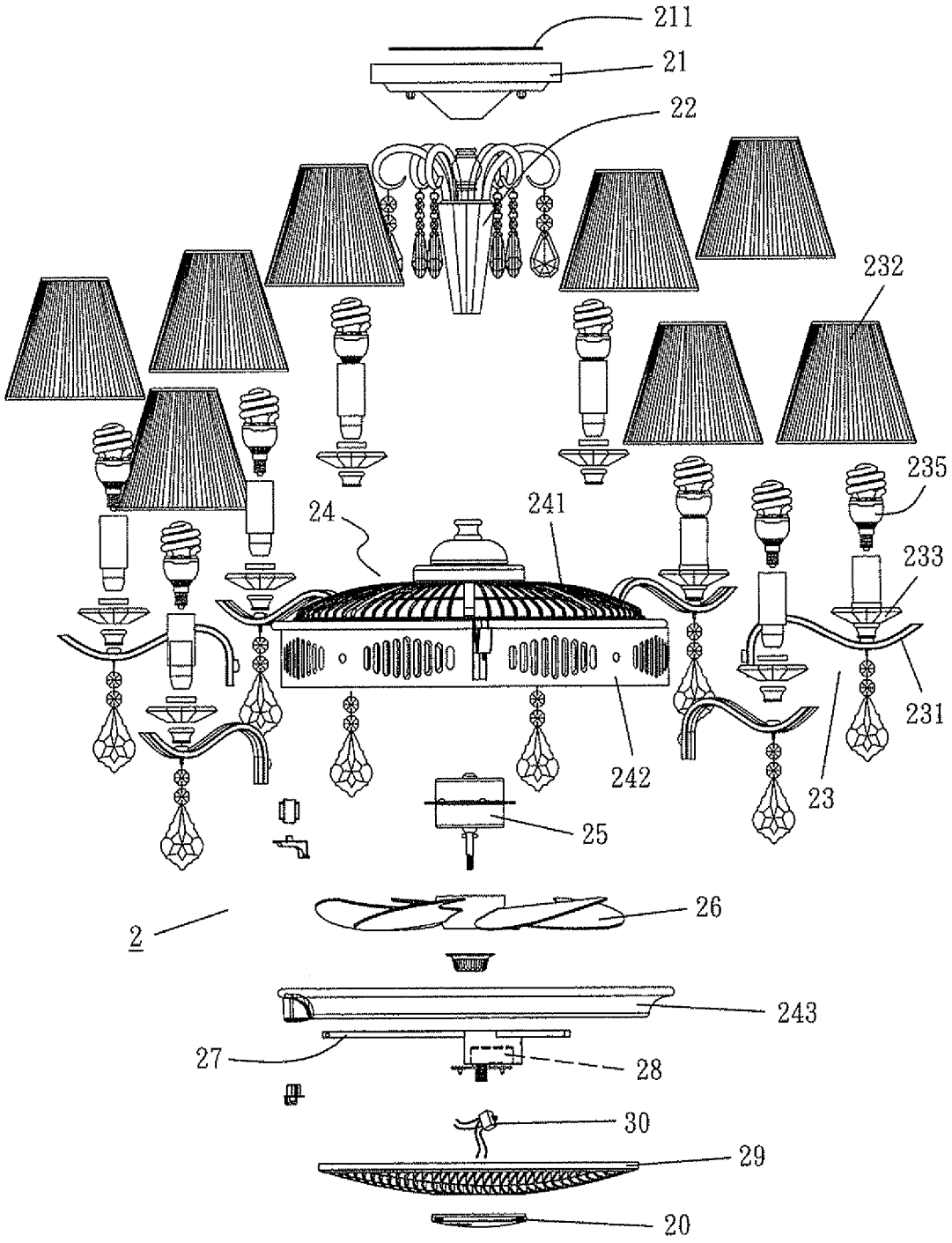
FIG. 7 is an exploded view of a second preferred embodiment of the present invention.
Figure 8:
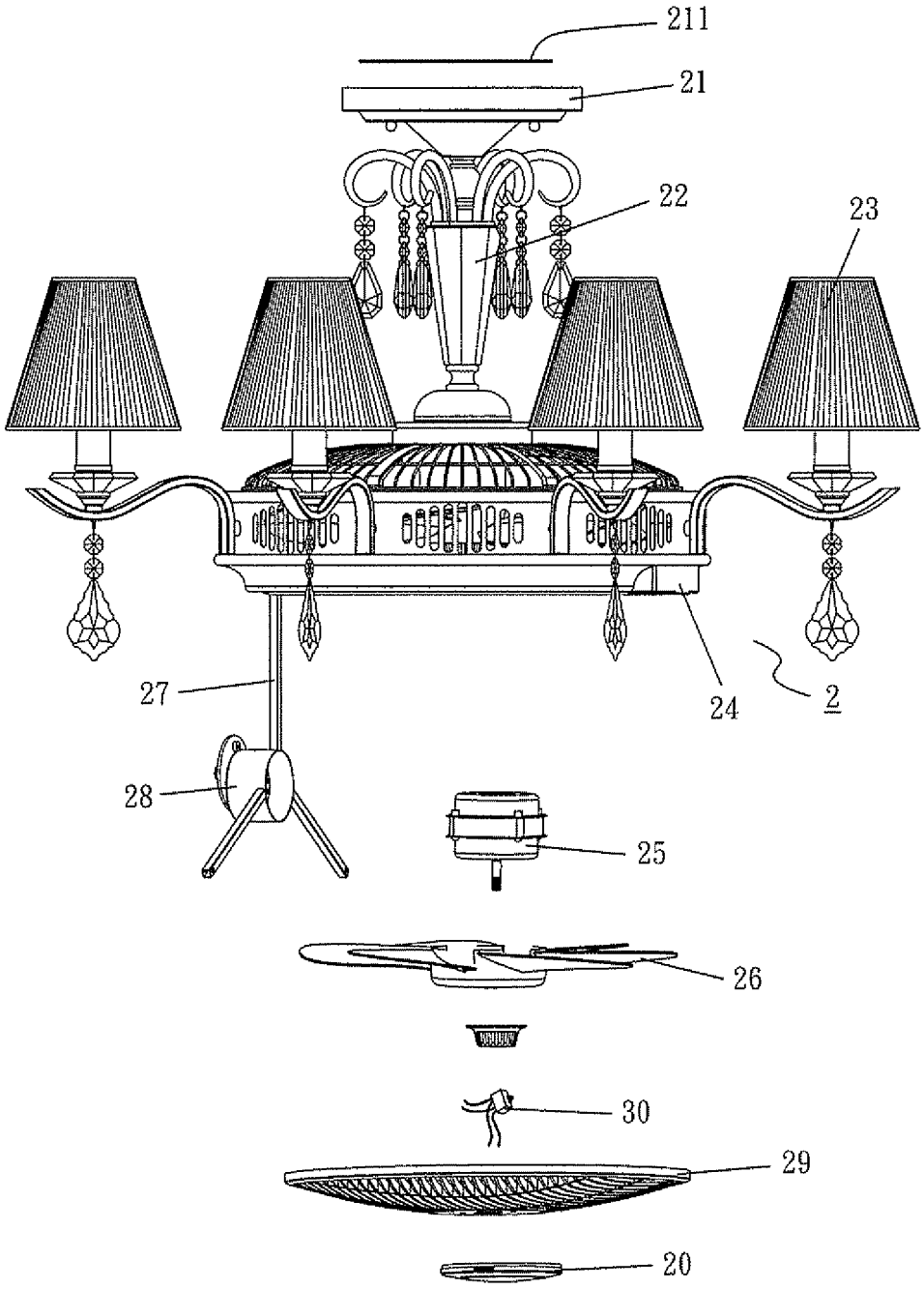
FIG. 8 is a schematic view of an operation of a second preferred embodiment of the present invention.

With reference to FIGS. 6 to 8 for a fan light apparatus in accordance with a second preferred embodiment of the present invention, the fan light apparatus 2 comprises a ceiling mount disk 21, a light frame 22, a lamp 23, a fan installing case 24, a fan motor 25, a vane 26, a support 27, a wind-guide fan motor 28, a wind-guide vane 29, a latch 20 and an anion generator 30. The ceiling mount disk 21 is secured with a mounting plate 211 and mounted to an installing position; the light frame 22 is a frame formed by a plurality of decorative bent bars, but the shape is not limited, and the top end at the center of the light frame 22 is coupled to the ceiling mount disk 21.

The fan installing case 24 is installed at the bottom of the light frame 22, ad the bottom of the fan installing case 24 is substantially in the form of an opening, and a plurality of air holes are formed at periphery of the top wall and the sidewall, and an installing space is formed therein; the fan installing case 24 is comprised of an upper cover 241, a middle ring 242 and a lower ring 243, and can come with different shapes, such as a fan installing case 24 formed by assembling the upper cover 241, the middle ring 242 and the lower ring 243 sequentially, or the upper cover 241 and the middle ring 242 are manufactured as a one-piece structure and then the lower ring 243 is coupled to the middle ring 242 from the bottom as shown in FIG. 7; or the upper cover 241, the middle ring 242 and the lower ring 243 are manufactured as a one-piece structure directly as shown in FIG. 8.

Each lamp 23 comprises a lamp arm 231, a lampshade 232, a lamp holder 233 and a light bulb 235, wherein the lamp arm 231 is allocated uniformly and coupled to the external periphery of the fan installing case 24, and the lamp holder 233 is coupled to the lamp arm 231 and coupled to lamp holder 233 through the light bulb 235, and then the lampshade 232 is sheathed to the lamp holder 233 for surrounding and covering the light bulb 235. Each lamp holder 233 is coupled to an electric wire which is passed through the light frame 22 and the ceiling mount disk 21 and electrically coupled to a power cable at the ceiling, such that each lamp holder 233 is electrically conducted for driving the light bulb 235 to be lit. The lampshade 232 can be of various different shapes, and the light bulb 235 can be an electric light emitting component, which can be a traditional light bulb (lamp tube), a power-saving light bulb (lamp tube), an LED light bulb (lamp tube) or any electric light emitting component.

The fan motor 25 is installed at the internal side of the top wall of the fan installing case 24, and the fan motor 25 is coupled to an electric wire which is passed through the light frame 22 and the ceiling mount disk 21 and then electrically coupled to a power cable at the ceiling, such that the fan motor 25 can be electrically conducted. The vane 26 is pivotally coupled to a spindle of the fan motor 25 and driven and rotated by the spindle of the fan motor 25. The support 27 is a rod-shaped object having at least two ends abutted against the lower ring 243 and at least one end movably coupled to the lower ring 243, so that the support 27 can be used as a movably coupled end or an end for detaching the lower ring 243, and the movably coupled end can serve as a fulcrum and in a drooping form (as shown in FIG. 8). Of course, the support 27 can be reinstalled anytime, so that it can be installed inside the lower ring 243.

The wind-guide fan motor 28 is installed at the center of the support 27, and the downwardly extended spindle is sheathed on the wind-guide vane 29, and then pivotally coupled to the spindle by the latch 20 for supporting the wind-guide vane 29. The wind-guide fan motor 28 and the fan motor 25 are connected in series for receiving the electric power jointly, and the wind-guide fan motor 28 is a power device for performing clockwise and counterclockwise rotations alternately, such that when the wind-guide vane 29 is driven and rotated, the wind-guide vane 29 also has the clockwise and counterclockwise rotations alternately. This operation is substantially the same as the operation of the fan light apparatus 1 of the first preferred embodiment, and the difference resides on that an anion generator 30 is installed in a space between the vane 26 and the wind-guide vane 29, and the electric power is connected with the fan motor 25 in series, such that users can control the generation of anions as required, and then the wind blown from the vane 26 can blow the anions downward.

The fan light apparatus 2 has the same effect of the fan light apparatus 1, and also has the effect of generating a large quantity of anions to provide a clean, hygienic and comfortable environment.

While the invention has been described by means of specific embodiments, numerous modifications and variations could be made thereto by those skilled in the art without departing from the scope and spirit of the invention set forth in the claims.

What is claimed is:

1. A fan light apparatus, comprising a ceiling mount disk, a light frame, a lamp, a fan installing case, a fan motor, a vane, a support, a wind-guide fan motor, a wind-guide vane and a latch; wherein the ceiling mount disk is installed and mounted to an installing position; the light frame is coupled to the ceiling mount disk; the lamp comprises a lamp holder and a light bulb, and the lamp holder is fixed onto the light frame, and then the light bulb is coupled to the lamp holder; the fan installing case is installed at the bottom of the light frame and surrounded by the lamp, and the bottom of the fan installing case is substantially in form of an opening, and a plurality of air holes are formed at peripheries of the top wall and the sidewall of the fan installing case, and an installing space is formed therein; the fan motor is installed to an internal side of the top wall of the fan installing case; the vane is pivotally coupled to the fan motor spindle and driven by the spindle of the fan motor spindle to rotate; the support is a rod-shaped object, and at least two ends are abutted against the internal edges of the bottom of the fan installing case, and at least one end is movably coupled to the internal edge of the bottom of the fan installing case; the wind-guide fan motor is a power device installed at the center of the support for performing clockwise and counterclockwise rotations alternately, and the spindle of the wind-guide fan motor is extended downward; the wind-guide vane is sheathed on the spindle of the wind-guide fan motor; and the latch is pivotally coupled to the wind-guide fan motor spindle for supporting the wind-guide vane; such that cool wind blown from the vane is provided for blowing in different directions alternately and facilitating a cleaning job.

2. The fan light apparatus of claim 1, wherein the light frame is a frame having a plurality of support arms in a decorative bent shape, whose center of the top side is coupled to the ceiling mount disk, and the bottom of the external periphery of each support arm is provided for coupling the lamp.

3. The fan light apparatus of claim 1, wherein the lamp comprises a lamp cup, a lampshade, a lamp holder, a combining part and a light bulb, and the lamp cup and the lamp holder are fixed to the light frame, and the lampshade is coupled to the lamp cup by screwing and securing the combining part with the lamp holder, and then the light bulb is coupled to the lamp holder.

4. The fan light apparatus of claim 1, wherein the lamp comprises a lamp arm, a lampshade, a lamp holder and a light bulb, and the lamp arm is disposed around the external periphery of the fan installing case, and the lamp holder is coupled to the lamp arm, and the light bulb is coupled to the lamp holder, and the lampshade is sheathed to the lamp holder for surrounding and covering the light bulb.

5. The fan light apparatus of claim 1, wherein the fan installing case is comprised of an upper cover, a middle ring and a lower ring.

6. The fan light apparatus of claim 5, wherein the upper cover, the middle ring and the lower ring fan installing case are manufactured as a one-piece structure.

7. The fan light apparatus of claim 5, wherein the upper cover and the middle ring of the fan installing case are manufactured as a one-piece structure, and then the lower ring is coupled to the middle ring from the bottom.

8. The fan light apparatus of claim 5, wherein the fan installing case is formed by assembling the upper cover, the middle ring and the lower ring sequentially.

9. The fan light apparatus of claim 1, further comprising an anion generator installed in a space between the vane and the wind-guide vane for generating anions, and the vane driving and blowing the anions by wind.

* * * * *